US006086436A

United States Patent [19]

Ishigaki

[11] Patent Number: 6,086,436

[45] Date of Patent: Jul. 11, 2000

[54] WATER JET PROPULSION DEVICE FOR MARINE VESSEL

[75] Inventor: Eiichi Ishigaki, Kagawa-ken, Japan

[73] Assignee: Ishigaki Company Limited, Tokyo, Japan

[21] Appl. No.: 09/125,129

[22] PCT Filed: Dec. 5, 1997

[86] PCT No.: PCT/JP97/04458

§ 371 Date: Aug. 11, 1998

§ 102(e) Date: Aug. 11, 1998

[87] PCT Pub. No.: WO98/25814

PCT Pub. Date: Jun. 18, 1998

[30] Foreign Application Priority Data

Dec. 11, 1996 [JP] Japan ..... 8-330997

[51] Int. Cl.[7] ..... B63H 11/00

[52] U.S. Cl. ..... 440/38; 440/40; 440/41; 440/42

[58] Field of Search ..... 440/38, 41, 42, 440/40; 416/234, 176

[56] References Cited

U.S. PATENT DOCUMENTS

| | | | |
|---|---|---|---|
| 4,411,630 | 10/1983 | Krautkremer et al. | 440/42 |
| 4,461,620 | 7/1984 | Brachet | 440/38 |
| 4,992,065 | 2/1991 | Torneman et al. | 440/41 |

*Primary Examiner*—S. Joseph Morano
*Assistant Examiner*—Lars A. Olson
*Attorney, Agent, or Firm*—Howard & Howard

[57] ABSTRACT

A pump frame (7) incorporates an upper opening (17), a lower opening (19) and a water passage (21) for connecting the two openings. To cause the lower opening (19) to be opened in water at a position adjacent a stern (1*a*) of a ship (1), the pump frame (7) is joined to a bottom (1*b*) of a ship (1). A pump casing (9) is secured to be stood erect above the pump frame (7). The pump casing (9) includes an impeller main shaft (33) stood erect. The impeller main shaft (33) is provided with an impeller (11) for sucking water from below the bottom (1*b*) through the lower opening (19) so as to pressurize the water. Water pressurized by the impeller (11) is jetted to a position behind the stern (1*a*) through a discharge pipe (13). As a result, the ship (1) is propelled. The foregoing water jet propulsion apparatus (5) enables sucking performance free from cavitation and excellent propelling performance to be obtained.

16 Claims, 5 Drawing Sheets

WATER JET PROPULSION DEVICE FOR MARINE VESSEL

BACKGROUND OF THE INVENTION

1. Technical Field

The present invention relates to a water jet propulsion apparatus for a ship, and more particularly to a propulsion apparatus having improved suction performance and navigating performance.

2. Background Art

A water jet propulsion apparatus is known and disclosed in, for example, Japanese Patent Laid-Open No. 5-270486. In that prior apparatus water is sucked into a suction opening in a bottom of a ship, the sucked water is pressurized by a horizontal impeller of a pump disposed above a surface of the water and the water is jetted to a position behind a stern of the ship so that the ship is propelled. Another water jet propulsion apparatus has been disclosed in, for example, Japanese Patent Publication No. 7-117076, which incorporates a volute casing disposed horizontally and within which an impeller is rotated to spirally swirl water sucked from a position below the bottom of the ship and to jet a swirl water flow to a position behind the stem of the ship. Both of these apparatuses have several disadvantages.

The water jet propulsion apparatus disclosed in Japanese Patent Laid-Open No. 5-270486 is designed so that the impeller of the pump is disposed above the surface of the water. Therefore, when the ship starts navigating, the internal portion of a pump casing must be at a negative pressure to lift water from below the surface of the water to the position of the impeller. This design requirement makes it difficult to begin movement of the ship.

Since the impeller is disposed apart from the bottom of the ship, a long passage in a suction portion of the impeller is required and thus, a long actual lift of water to the impeller is required and great resistance is generated in the suction portion. As a result, cavitation takes place when the ship is navigated at high speed.

The propulsion apparatus is secured to the ship at the suction portion, which is supported at the bottom of the ship, and at the discharge portion, which is supported at the stern of the ship. This structural requirement makes it difficult to align a main shaft of the impeller with the axis of a drive shaft of a motor. A deviation between the alignment of the two shafts must be absorbed by force of some play in the system. Play in the system is provided by securing a projection portion to the stern. If the two shafts are connected to each other by an eccentricity, the main shaft, which is disposed horizontally, is deflected by the force of the weight of the impeller and vibrations of the motor are transmitted to the main shaft. This causes the rotating impeller to contact the bottom of the pump casing causing the impeller to be worn. Thus, there is apprehension that an adverse influence is exerted on the efficiency of the pump.

The water jet propulsion apparatus disclosed in Japanese Patent Publication No. 7-117076 is designed so that the volute pump casing is disposed horizontally. Therefore, if the ship is separated from the surface of water because of waves air can be sucked together with water into the apparatus, and the air cannot easily be discharged.

The trapped air generates eddy currents of air causing cavitation to take place. As a result of the cavitation, the propelling performance of the apparatus deteriorates.

The present invention is designed to solve the abovementioned problems, and an objective of the present invention is to provide a water jet propulsion apparatus that is capable of reducing the resistance which arises when water is introduced into the apparatus, reducing the cavitation that occurs when a ship is navigated at high speed, and that can easily be mounted to a ship.

SUMMARY OF THE INVENTION

According to the present invention, there is provided a water jet propulsion apparatus for a ship, comprising: a pump frame having an upper opening, a lower opening and a water passage for establishing a communication between the upper and lower openings, the pump frame is joined to a bottom of a ship in such a manner that the lower opening is opened into water adjacent to a stern of the ship; a pump casing having an introduction portion and a discharge portion, the pump casing stood erect above the pump frame in such a manner that the introduction portion is continued to the upper opening; an impeller provided for a main shaft, the shaft stood erect in an inside portion of the pump casing and arranged to be rotated, the impeller sucking water from below the bottom of the ship through the lower opening so as to pressurize the water; and a discharge pipe having a first end connected to the discharge portion of the pump casing, the discharge pipe arranged to jet out water pressurized by the impeller from a second end thereof toward a position behind the stern.

Since the structure is arranged as described above, water introduced from the water passage into the mixed flow pump is accelerated while water is pressurized by the blades of the impeller. Then, water is moved in the discharge pipe so as to be jetted to the rear portion of the stern so that the ship is forwards navigated.

The above-mentioned structure is arranged so that the propulsion apparatus is secured to the ship by joining the pump casing to the pump frame. That is, the propulsion apparatus is secured to the ship at only one position in the suction portion thereof. Therefore, the process for locating the main shaft of the impeller to a predetermined position with respect to a drive shaft of a motor can easily be performed. As a result, deviation of the axis of the main shaft can reliably be prevented. Since the main shaft of the impeller is stood erect in the pump casing, deflection of the main shaft due to the weight of the impeller can be prevented. Therefore, even if vibrations of the motor are transmitted to the main shaft, the rotating impeller cannot easily be brought into contact with the pump casing. As a result, deterioration in the efficiency of the pump occurring from abrasion of the impeller can be prevented.

Since the stand-up pump casing in which the main shaft of the impeller is located is stood erect above the pump frame, air introduced into the pump casing from the bottom of the ship can easily be discharged even if air is introduced because the ship is separated from water by waves. Therefore, deterioration in the propelling performance occurring because of generation of cavitation can be prevented.

The water passage of the pump frame has a short length because the pump casing is disposed adjacent to the bottom of the ship, and so a lowermost portion of the impeller may be disposed below a surface of water.

As a result of the above-mentioned structure, the lowermost portion of the impeller is disposed below the surface of water. Thus, the negative pressure in the introduction portion of the pump casing and the water pressure below the surface of water are able to realize a state in which water reaches the impeller because water can easily be introduced through the lower opening of the pump frame. Therefore, the operation of the apparatus can easily be started.

Since the water passage of the pump frame has a short length and the pump casing is disposed adjacent to the bottom of the ship, an actual lift to the impeller can be lowered. Therefore, suction resistance in the suction portion can be reduced. Thus, generation of cavitation when the ship is navigated at high speed can reliably be prevented.

A width of the lower opening of the pump frame may be enlarged toward a stem of the ship.

The above-mentioned structure enables water flow below the bottom of the ship to be widely picked up during navigation of the ship. Since air sucked into the mixed flow pump through the lower opening can easily be discharged, deterioration in the propelling performance caused from generation of cavitation can furthermore reliably be prevented.

A structure may be employed in which a front of the lower opening of the pump frame adjacent to a stem of the ship is placed more closely adjacent to the stem as compared with a position directly below a front end of the upper opening and a front portion of the water passage of the pump frame adjacent to the stem is upwardly inclined toward the stern of the ship.

The above-mentioned structure enables water below the bottom of the ship to be smoothly introduced into the mixed flow pump during navigation of the ship without any opposition to the flow of water.

A structure may be employed in which a rear portion of the pump frame adjacent to the stern of the ship projects downwards and over a portion of the bottom of the ship and the lower opening of the pump frame is inclined in such a manner that its angle relative to the bottom of the ship is not less than 20 degrees nor more than 30 degrees.

The above-mentioned structure is arranged such that the rear portion of the pump frame projects downwards over a portion of the bottom of the ship and receives water flow from below the bottom and introduces the water flow into the water passage. Therefore, the water flow can efficiently be introduced into the water passage.

The first end of the discharge pipe may extend toward the discharge portion of the pump casing, the second end of the discharge pipe may extend horizontally, and the two ends of the discharge pipe may be joined by a curved portion.

Since the above-mentioned structure causes water pressurized and accelerated by the impeller to be moved in the curved discharge pipe, pipe resistance in the discharge pipe can be reduced.

A structure may be employed in which blades of the impeller are spirally joined to the main shaft, outer ends of the blades are disposed adjacent to an inner surface of the pump casing and the outer leading ends of the blades adjacent to the introduction portion extend downward to a position adjacent to the water passage of the pump frame, and long and twisted guide blades are disposed more closely adjoined to the discharge portion than the blades of the impeller.

In the above-mentioned structure, water introduced into the pump casing through the water passage in the pump frame is accelerated while water is pressurized by the sequential and spiral blades of the impeller. Then, water is guided along the twisted guide blades in the axial direction of the main shaft of the impeller so that the water is rectified. The impeller generates strong sucking force in the screw blades in the front portion thereof by force of the propelling force thereof. Since the blades of the impeller are continuously formed, centrifugal force is generated in the rear portion of the impeller. Therefore, energy added to water in the front portion of the impeller can be converted into energy of pressure energy. Therefore, sucking performance and propelling performance can be improved.

A structure may be employed in which the main shaft has a first end and a second end, the first end is extended downwardly into the pump casing and the second end is connected to a horizontal driveshaft located outside of the pump casing through a transmission.

The above-mentioned structure has the arrangement that the driveshaft of the motor and the main shaft of the impeller are not on a straight line relative to each other. Therefore, a previous necessity of making the axes of the two shafts coincide with each other can be eliminated. Therefore, a locating process for locating the main shaft of the impeller at a predetermined position with respect to the driveshaft of the motor can furthermore easily be performed. Moreover, the transmission is able to arbitrarily adjust the number of revolutions of the impeller as desired.

DETAILED DESCRIPTION OF THE PREFERRED EMBODIMENT

A first embodiment of the present invention will now be fully described with reference to the drawings.

Figure 1:
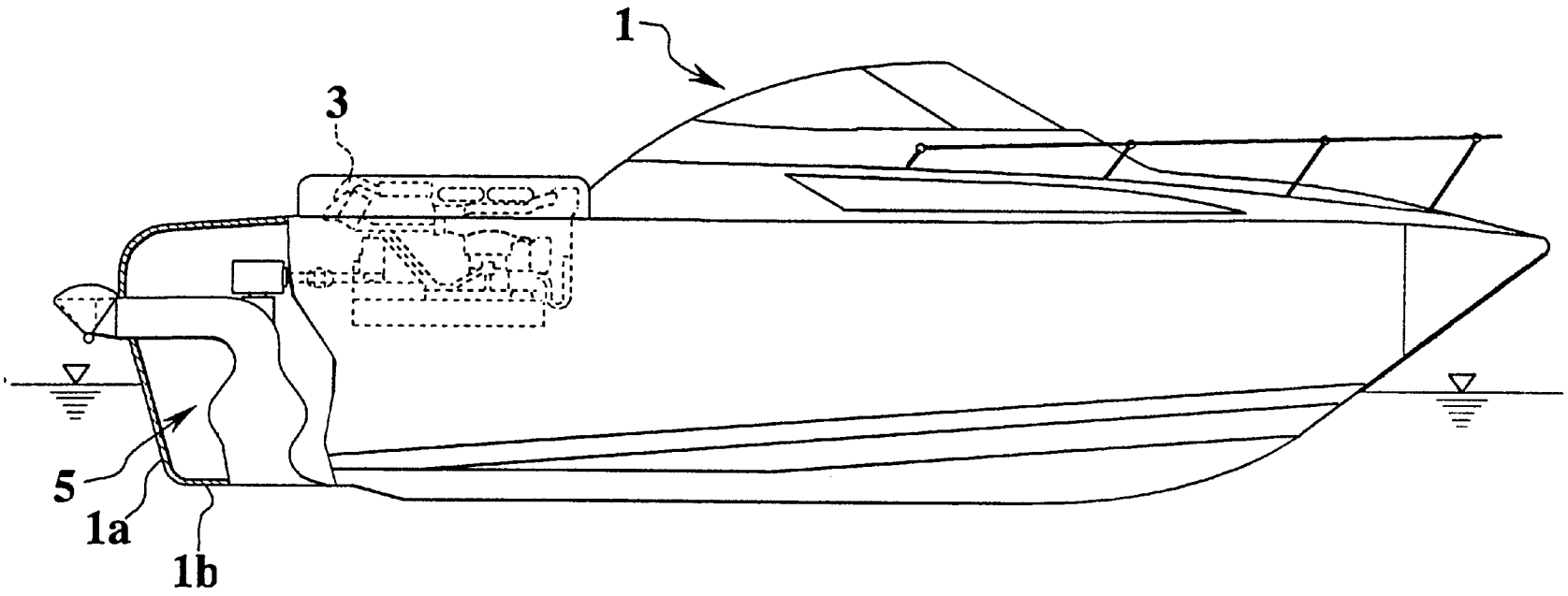
FIG. 1 is a vertical side view schematically showing a ship having a water jet propulsion apparatus designed according to a first embodiment of the present invention.

As shown in FIG. 1, a standup water jet propulsion apparatus 5 is connected to an engine (a motor) 3 disposed adjacent to a stem 1*a* of a ship 1. The water jet propulsion apparatus 5 sucks water from below a bottom 1*b* of the ship 1 and jets pressurized and accelerated jet water to a position behind the stem 1*a*. Thus, the ship 1 is propelled by force of the jetted water.

Figure 2:
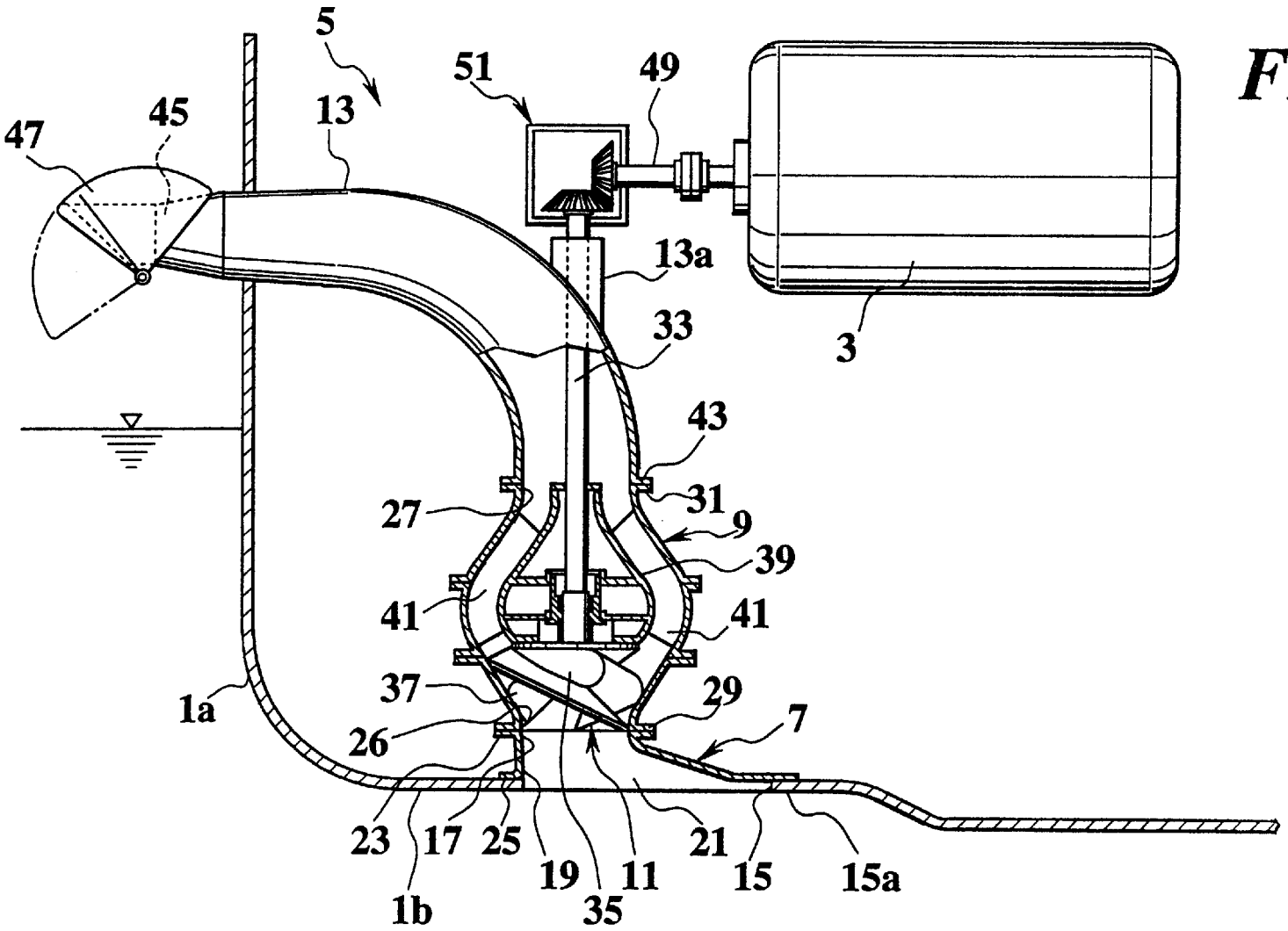
FIG. 2 is a vertical partial cross sectional view showing a side portion of the water jet propulsion apparatus shown in FIG. 1.

As shown in FIG. 2, the propulsion apparatus 5 incorporates a pump frame 7, a pump casing 9, an impeller 11 and a discharge pipe 13.

Figure 3:
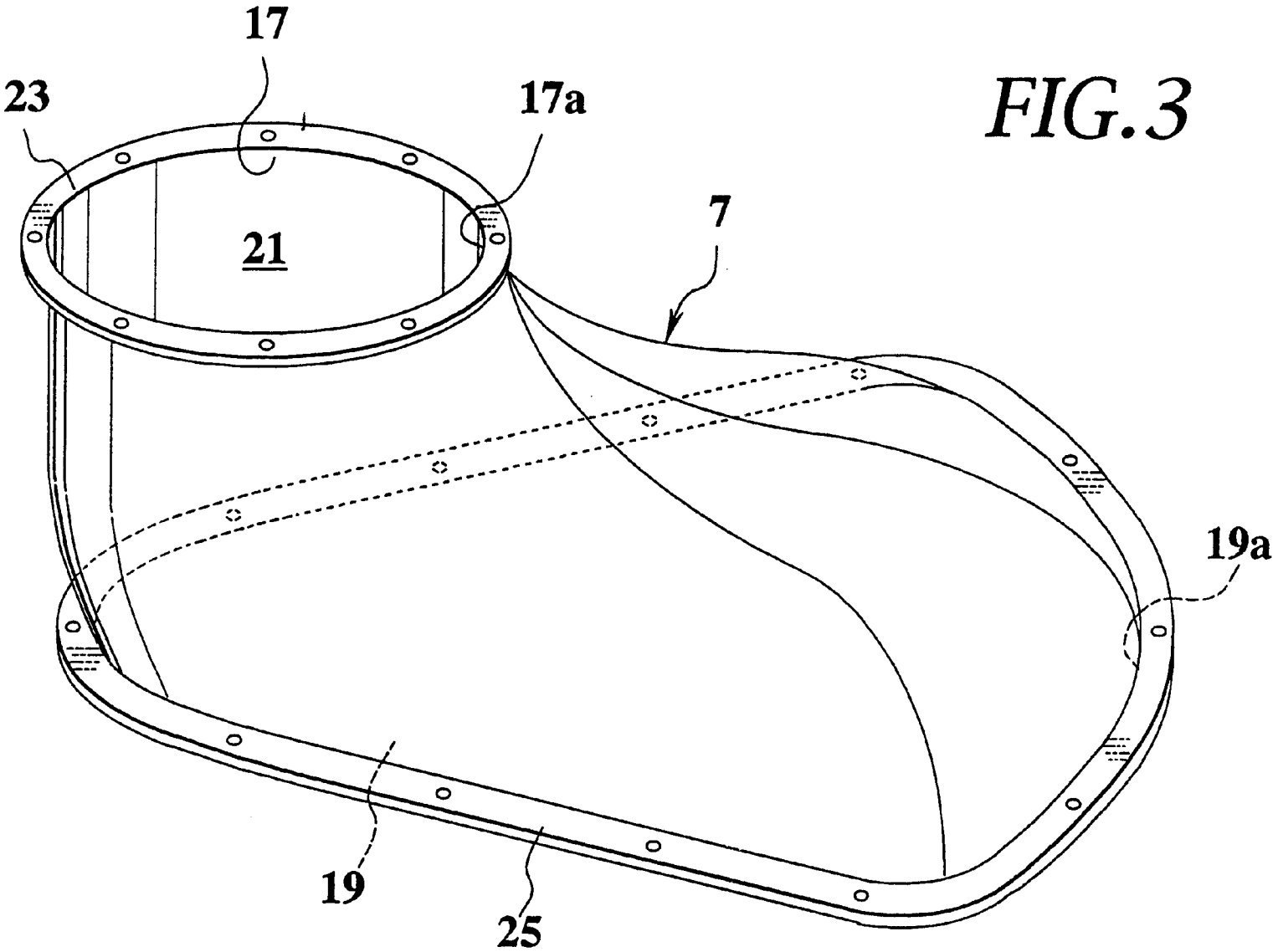
FIG. 3 is a perspective view of a pump frame shown in FIG. 2.

An opening 15 is formed in the bottom 1*b* at a position adjacent to the stern 1*a*. The pump frame 7 is secured to a periphery 15*a* of the opening 15. As shown in FIG. 3, the pump frame 7 is formed into a somewhat cylindrical shape having an 17, a lower opening 19, and a water passage 21 connecting the upper opening 17 to the lower opening 19.

Connecting flanges 23 and 25 are formed on the peripheries of the upper opening 17 and the lower 19, respectively. The lower opening 19 is formed into a generally triangular shape. Lower opening 19 includes a widened front end 19*a* that is oriented toward a stem of ship 1. Front end 19*a* of the lower opening 19 is disposed more closely to the stem as compared with the position of a front end 17*a* of the upper opening 17. As a result, the lower opening 19 has a shape that extends toward the stem as compared with the upper opening 17. The pump frame 7 has a low shape and the water passage 21 has a short length. As a result, the pump casing 9 (see FIG. 2) is disposed adjacent to bottom 1*b* and the lower end of the impeller 11 is disposed below the surface of the water. A front portion of the water passage 21 adjacent to the stem is inclined upwards to because of the deviation between the front ends 17*a* and 19*a* of the upper opening 17 and the lower opening 19. The pump frame 7 having the above-mentioned structure is, as shown in FIG. 2, secured to the bottom 1*b* by securing connecting flange 25 in the periphery of the introduction opening 19 to a periphery 15*a* of the opening 15 with bolts (not shown). The lower opening 19 is thus open to the water at a position adjacent to the stern 1*b*. Although in this embodiment lower opening 19 has a generally triangular shape, lower opening 19 could have other shapes, for example, a circular shape, an elliptic shape or a rectangular shape, may be employed.

The pump casing 9 has an introduction opening 26 opened downwards and a discharge opening 27 opened upwards. To cause the introduction opening 26 to be in communication with the upper opening 17 of the pump frame 7, the pump casing 9 is mounted to the pump frame 7. Connecting flanges 29 and 31 are provided at the outer peripheries of the introduction opening 26 and the discharge opening 27, respectively, of the pump casing 9. When the flange 29 in the periphery of the introduction opening 26 is connected to the flange 23 in the periphery of the connection opening 17 with bolts, the pump casing 9 is secured to the pump frame 7. As described above, the pump frame 7 has a low shape. The pump casing 9 is disposed adjacent to the bottom 1*b* in such a manner that the lower end of the pump casing 9 is disposed below the surface of the water.

An impeller shaft (a main shaft) 33 is rotatively disposed in the pump casing 9. The impeller main shaft 33 includes a first end that extends downwards from a position outside of the pump casing 9 into the pump casing 9. The impeller 11 sucks water from below the bottom 1*b* through the lower opening 19 so as to pressurize the water.

Figure 4:
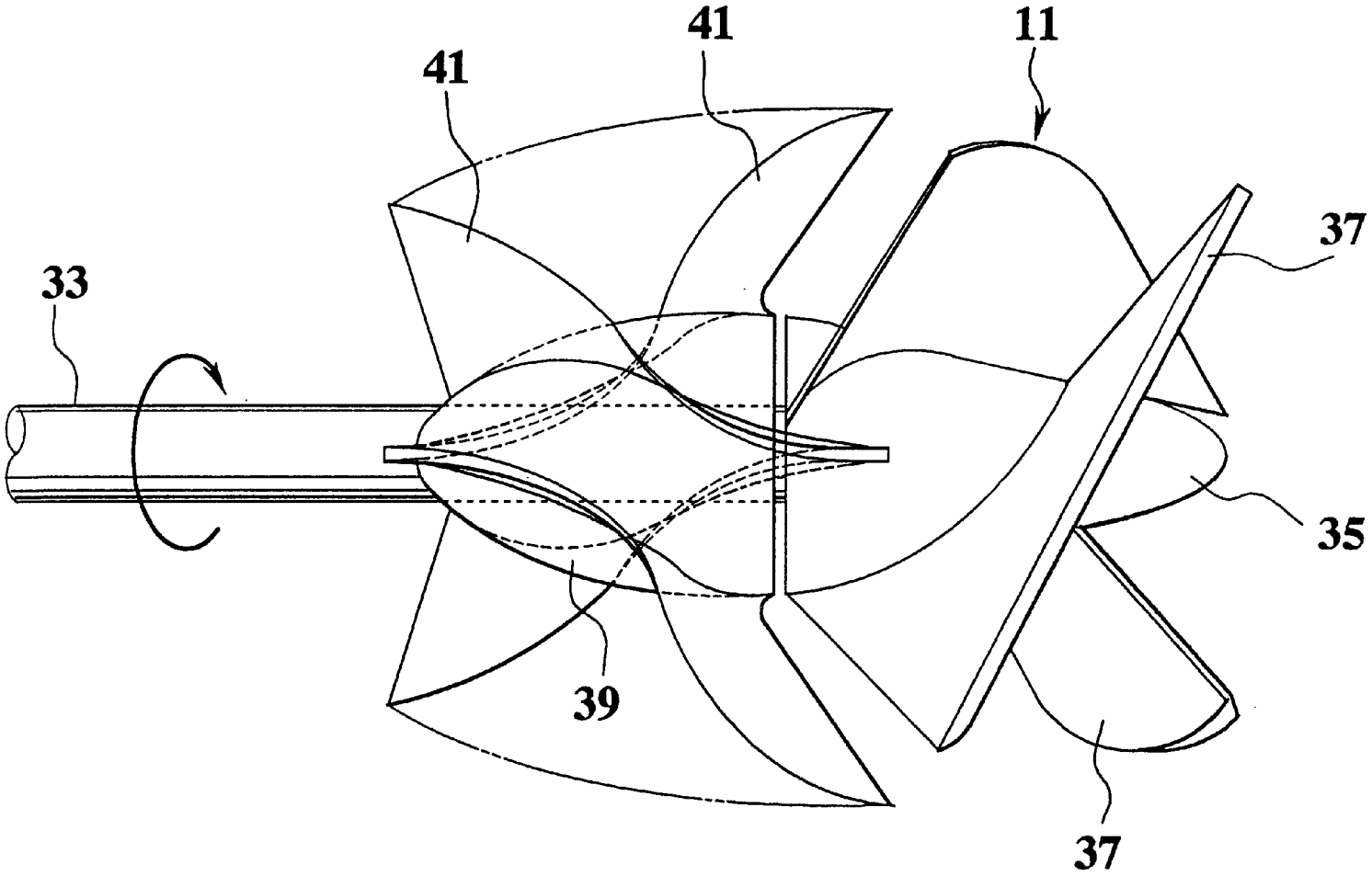
FIG. 4 is a side view showing the shape of an impeller and guide blades shown in FIG. 2.

As shown in FIG. 4, the impeller 11 includes a hub 35 secured to the first end of the impeller main shaft 33 and three spiralshaped blades 37 project from hub 35. As shown in FIG. 2, the outer peripheries of the blades 37 are disposed adjacent to an inner surface of the pump casing 9 in order to improve a volumetric efficiency and a balance efficiency of the pump. As shown in FIG. 2, the leading ends (lower portions) of the blades 37 adjacent to the introduction opening 26, extend downward to a position adjacent to upper opening 17 so that the lowermost portion of the blades 37 is disposed below the surface of the water. Since the impeller 11 has a large sucking portion, the sucking performance of the pump can be improved. This design also prevents the portion of the impeller 11 from being clogged with suspended matter introduced into the pump frame 7. Note that the number of blades 37 of the impeller 11 can arbitrarily be changed to be adaptable to the size of the ship 1.

The inner surface of the pump casing 9 has a parabolic shape. The pump casing 9 is rotatively supported by a bearing case 39, which is located at a position closer to the discharge opening 27 (upper portion) as compared with the blades 37. Dish-shape water passages are formed by sectioning the portion between the inner surface of the pump casing 9, the hub 35 and the bearing case 39. Thus, water introduced through the suction portion of the introduction opening 26 is pressurized and formed into spiral swirl flows by the surfaces of the blades 37 of the impeller 11.

As shown in FIG. 4, a portion of the water passage in the rear of the impeller 11, namely, the water passage around the impeller shaft 33 from the blades 37 to the discharge opening 27, is provided with four long and twisted guide blades 41. The guide blades 41 project over the bearing case 39. A portion adjacent to the leading ends of the guide blades 41 forms a water passage for parabolically guiding swirl flows pressurized by the impeller 11, while a portion adjacent to the trailing ends of the guide blades 41 forms a water passage for converting the guided swirl flows into straight flows. Also the number of the guide blades 41 may arbitrarily be changed similarly to the number of the blades 37.

The discharge pipe 13 has an L-shape having first end extending upwards and a second end extending horizontally. The first end and second end are connected to each other through a curved portion. The first end of the discharge pipe 13 is connected to the top end of the pump casing 9 so as to be in communication with the discharge opening 27 of the pump casing 9. The two ends are connected to each other by securing a flange 43 on the first end to a flange 31 on the discharge opening 27 of the pump casing 9 with bolts. The second end of the discharge pipe 13 is supported by stern 1*a*. The second end of the discharge pipe 13 includes a jet nozzle 45. Jet water pressurized and accelerated by the impeller 11 is squeezed by the jet nozzle 45 so as to be jetted behind the stern 1*a*. Thus, the ship 1 is navigated forwards. The jet nozzle 45 includes a reverser 47 for reversely navigating the ship 1. The reverser 47 switches the direction in which jet water is jetted from the jet nozzle 45 from a direction behind the stern 1*a* to a direction toward the stern 1*a*. When jet water is jetted toward the stern 1*a*, the ship 1 is navigated in reverse.

A second end of the impeller main shaft 33 opposite the hub 35 extends through the first end of the discharge pipe 13, and then extends outwards through a bearing portion 13*a* of the discharge pipe 13. A drive shaft 49 of the engine 3 is horizontally disposed outside of the pump casing 9. A leading end of the drive shaft 49 and the second end of the impeller main shaft 33 are connected to each other through a bevel gear 51, which serves as a transmission as is known in the art.

The operation of this embodiment will now be described.

In the above-mentioned propulsion apparatus 5, water below the bottom 1*b* is sucked through the lower opening 19 of the pump frame 7 so as to be introduced into the pump casing 9 through the water passage 21. Then, water is pressurized and accelerated by the blades 37 of the impeller 11, and then moved through the discharge pipe 13. Thus, jet water is jetted from the jet nozzle 45 to a position behind the stern 1*a* so that the ship 1 is navigated forwardly.

The impeller 11 has the blades 37 spirally joined to the impeller shaft 33. Moreover, the outer peripheries of the blades 37 are positioned adjacent to the inner surface of the pump casing 9. In addition, the leading ends of the introduction portions of the blades 37 extend downwards to a position adjacent to the water passage 21 of the pump frame 7. Moreover, the long and twisted guide blades 41 are provided around the portion of the impeller shaft 33 closer to the discharge opening 27 as compared with the blades 37. Therefore, water introduced into the pump casing 9 through the water passage 21 of the pump frame 7 is pressurized and accelerated by the sequential and spiral blades 37. Then, water is guided by the twisted guide blades 41 in the axial direction of the impeller shaft 33 so as to be rectified. The impeller 11 having screw blades 37 provided in the forward portion thereof generates strong sucking action because of the propelling force of the screw blades 37. Since the blades 37 of the impeller 11 are continued, centrifugal force is generated in the rear portion of the impeller 11. Therefore, energy added to water in the front portion of the impeller 11 can be converted into pressure energy. As a result, excellent sucking performance and propelling performance can be obtained.

The water jet propulsion apparatus 5 is secured to the ship 1 such that bolts secure the pump casing 9 to the pump frame 7, which is secured to the bottom 1*b* with bolts. That is, the water jet propulsion apparatus 5 is secured to the ship 1 at one position in the suction portion (adjacent to the lower opening 19). Therefore, a process for disposing the impeller shaft 33 at a predetermined position with respect to the drive shaft 49 can easily be performed as compared with the method in which two ends are secured. As a result, deviation of the axis of the impeller shaft 33 can reliably be prevented. Since the impeller shaft 33 is stood erect in the pump casing 9, deflection of the impeller shaft 33 by the force of the weight of the impeller 11 can be prevented. Therefore, even if vibrations of the engine 3 are transmitted to the impeller shaft 33, the rotating impeller 11 cannot easily be brought into contact with the pump casing 9. As a result, deterioration in the efficiency of the pump occurring as a result of abrasion of the impeller 11 against the inner surface can be prevented.

Since the stand-up pump casing 9, in which the impeller shaft 33 is located, is stood erect above the pump frame 7, air introduced into the pump casing 9 through the lower opening 19 of the bottom 1*b* can easily be discharged in a case where the ship 1 is separated from the water by waves as compared with the conventional structure that incorporates a volute pump casing. Therefore, deterioration in the propelling performance occurring because of generation of cavitation can be prevented.

Since the lowermost portion of each of the blades 37 of the impeller 11 is lower than the surface of the water, the negative pressure in the introduction opening 26 of the pump casing 9 and the water pressure below the surface of water realize a state in which water reaches the impeller 11 because water can easily be introduced through the lower opening 19 of the pump frame 7 when navigation is started. As a result, the start of navigation can easily be performed.

Since the water passage 21 of the pump frame 7 has a short length to cause the pump casing 9 to be disposed adjacent to the bottom 1*b*, the actual lift to the impeller 11 can be reduced. Thus, the suction resistance in the suction portion is reduced. As a result, generation of cavitation when the ship 1 is navigated at high speed can reliably be prevented.

Since the lower opening 19 of the pump frame 7 is formed into the triangular shape having the width which is enlarged in the direction toward the stem, water flowing below the bottom 1*b* can widely be picked up during navigation of the ship 1. Since air sucked into the pump casing 9 through the lower opening 19 can furthermore easily be discharged, deterioration in the propelling performance occurring because of generation of cavitation can furthermore reliably be prevented.

The front end 19*a* of the lower opening 19 of the pump frame 7 is positioned closer to the stem as compared with the position directly below the front end 17*a* of the upper opening 17. Moreover, the front portion of the water passage 21 of the pump frame 7 is inclined upwards toward the stern 1*a*. Therefore, water below the bottom 1*b* can smoothly be introduced into the pump casing 9 without opposition to the flow of water.

Since the discharge pipe 13 has a shape wherein the first end and second end are connected by a curved portion, water pressurized and accelerated by the impeller 11 is moved through the curved discharge pipe 13 with low resistance.

The end of the impeller shaft 33 is extended downwards into the pump casing 9. The other end of the impeller shaft 33 is, at the position on the outside of the pump casing 9, connected to the drive shaft 49, which is disposed horizontally such that the other end is connected through the bevel gear 51 and they are oriented substantially perpendicularly to each other. Since the drive shaft 49 and the impeller main shaft 33 are not disposed on a straight line, the conventional structure which requires that the axes of the two shafts must be made to completely coincide with each other can be eliminated. Therefore, the process for locating the impeller shaft 33 at a predetermined position with respect to the drive shaft 49 can furthermore easily be performed. When the gear ratio of the bevel gear 51 is changed, the number of revolutions of the impellers 11 can be adjusted and changed, if necessary.

A second embodiment of the present invention will now be described with reference to FIG. 5.

Figure 5:
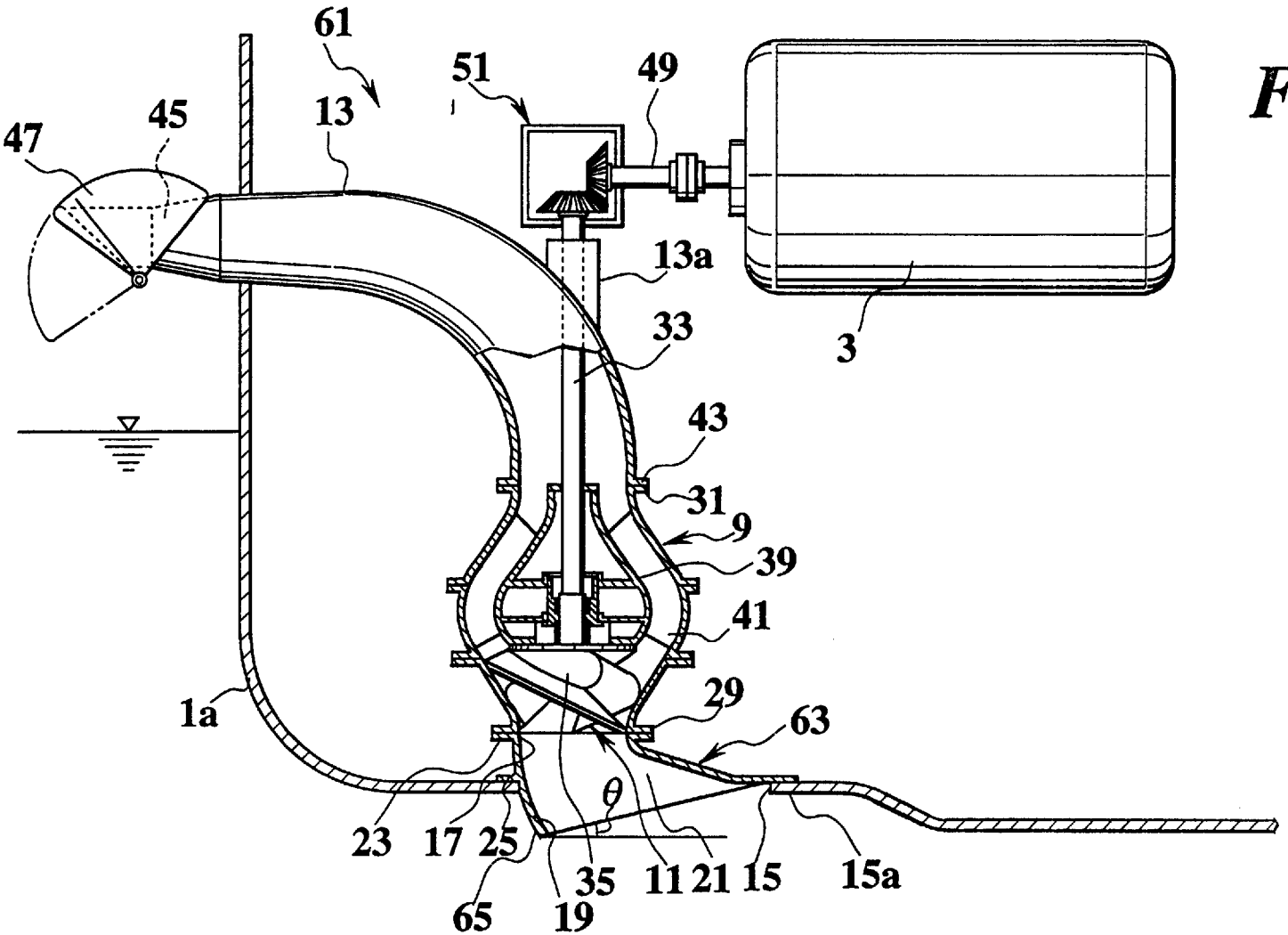
FIG. 5 is a vertical partial cross sectional view showing a side portion of a water jet propulsion apparatus designed according to a second embodiment of the present invention.

A propulsion apparatus 61 according to this embodiment, as shown in FIG. 5, includes a projection 65 located on a lower portion of a pump frame 63 adjacent to the stern 1*a*. The projection 65 extends into the water and projects downwards over a portion of the bottom 1*b* so as to section the lower opening 19. The lower opening 19 is upwardly inclined and makes an angle relative to the bottom 1*b* of not less than 20 degrees nor more than 30 degrees ($20° \leqq \theta \leqq 30°$ as shown in FIG. 5). The other structures are similar to those according to the first embodiment. Therefore, the similar elements are given the same reference numerals and the similar elements are omitted from description.

According to this embodiment, the projection 65 receives water flowing below the bottom 1*b* so that the water flow is introduced into the water passage 21 and the water flow can efficiently be introduced into the water passage 21. Therefore, in addition to the effect obtainable from the first embodiment, the propelling force can be enlarged because the amount of introduced water can be enlarged.

As described above, the water jet propulsion apparatus 5 according to the present invention facilitates the process for locating the main shaft 33 of the impeller 11 with respect to the drive shaft 49 of a motor when the water jet propulsion apparatus 5 is secured to the ship 1. Therefore, deviation of the axis of the main shaft 33 can reliably be prevented. Moreover, deflection of the main shaft 33 due to the weight of the impeller 11 can be prevented. Even if vibrations of the motor 3 are transmitted to the main shaft 33, the rotating impeller 11 cannot easily be brought into contact with the pump casing 9. Therefore, deterioration in the efficiency of the pump occurring because of abrasion of the impeller 11 can be prevented. Even if the ship 1 is separated from the water because of waves and air is introduced into the pump casing 9 through the bottom 1*b* of the ship 1, air can easily be discharged. Therefore, deterioration in the propelling performance occurring because of generation of cavitation can be prevented.

That is, the water jet propulsion apparatus 5 according to the present invention has suction performance free from cavitation and excellent propelling performance. Moreover, the water jet propulsion apparatus 5 can easily be mounted. Therefore, the structure according to the present invention is advantageous as a propulsion source for a variety of ships 1.

What is claimed is:

1. A water jet propulsion apparatus for a ship, comprising:

a pump frame having an upper opening, a lower opening and a water passage communicating between said upper and said lower openings, said pump frame joined to a bottom of a ship with said lower opening adapted to be opened into water adjacent to a stern of said ship;

a pump casing having an introduction portion and a discharge portion, said pump casing oriented erect above said pump frame, with said introduction portion in communication with said upper opening;

an impeller on a main shaft, said shaft orientated erect in a portion of said pump casing and adapted arranged to be rotated, rotation of said the impeller sucking water from below said bottom of said ship through said lower opening so as to pressurize the water;

a discharge pipe having a first end connected to said discharge portion of said pump casing, said discharge pipe jetting out water pressurized by said impeller from a second end of said discharge pipe to a position behind said stern;

said impeller includes a plurality of blades that are spirally joined to said main shaft, said blades having outer ends disposed adjacent to an inner surface of said pump casing and said blades having outer leading ends disposed adjacent to said introduction portion extending downwards to a position adjacent to a water passage of the pump frame; and a plurality of long and twisted guide blades projecting over a bearing case and disposed more closely adjacent to said discharge portion than said blades of said impeller.

2. A water jet propulsion apparatus according to claim 1, wherein said water passage of said pump frame has a short length and said pump casing is disposed adjacent to said bottom of said ship, and a lowermost portion of said impeller is adapted to be disposed below a surface of a water.

3. A water jet propulsion apparatus according to claim 1, wherein a width of said lower opening of said pump frame is enlarged at a front end located toward a stem of said ship.

4. A water jet propulsion apparatus according to claim 1, wherein a front end of said lower opening of said pump frame is placed more closely adjacent to a stem of said ship than a front end of said upper opening, and a front portion of said water passage of said pump frame is upwardly inclined toward said stern of said ship.

5. A water jet propulsion apparatus according to claim 1, wherein a rear portion of said pump frame includes a projection that projects downwards and over a portion of said bottom of said ship.

6. A water jet propulsion apparatus according to claim 5, wherein said lower opening of said pump frame is inclined at an angle relative to said bottom of said ship that is not less than 20 degrees nor more than 30 degrees.

7. A water jet propulsion apparatus according to claim 1, wherein said first end of said discharge pipe extends toward said discharge portion of said pump casing, said second end of said discharge pipe extends horizontally, and said first and said second end of said discharge pipe are joined by a curved portion.

8. A water jet propulsion apparatus according to claim 1, wherein said main shaft has a first end and second end, said first end extending downwards into said pump casing and said second end is connected through a transmission to a horizontal drive shaft located outside of said pump casing.

9. A water jet propulsion apparatus for a ship, comprising:

a pump frame having an upper opening, a lower opening and a water passage communicating between said upper and said lower openings, said pump frame adapted to be secured to a bottom of a ship with said lower opening adapted to be open to the bottom of the ship;

a pump casing having an introduction portion and a discharge portion, said pump casing oriented above said pump frame with said introduction portion in communication with said upper opening;

an impeller on a main shaft, said main shaft rotatable and extending vertically from said pump casing, rotation of said impeller for pulling water from below the bottom of the ship through said lower opening so as to pressurize the water;

a discharge pipe having a first end connected to said discharge portion of said pump casing, said discharge pipe adapted to jet out water pressurized by said impeller from a second end of said discharge pipe; and said impeller includes a plurality of blades that are spirally joined to said main shaft, said blades having outer ends disposed adjacent to an inner surface of said pump casing and said blades having outer leading ends disposed adjacent to said introduction portion and extending downwards to a position adjacent to said water passage of said pump frame, and a plurality of long and twisted guide blades projecting over a bearing case and disposed more closely adjacent to said discharge portion than said blades of said impeller.

10. A water jet propulsion apparatus according to claim 9, wherein said water passage of said pump frame has a short length and said pump casing is adapted to be disposed closely adjacent to the bottom of a ship, and a lowermost portion of said impeller is adapted to be disposed below a surface of the water.

11. A water jet propulsion apparatus according to claim 9, wherein a width of said lower opening of said pump frame is enlarged at a front end.

12. A water jet propulsion apparatus according to claim 9, wherein a front end of said lower opening of said pump frame extends beyond a front end of said upper opening, and a front portion of said water passage of said pump frame is inclined upwardly between said front end of said lower opening and said front end of said upper opening.

13. A water jet propulsion apparatus according to claim 9, wherein said pump frame includes a rear portion having a projection that projects downwards and that is adapted to extend over a portion of the bottom of a ship.

14. A water jet propulsion apparatus according to claim 13, wherein said lower opening of said pump frame is inclined at an angle relative to a horizontal at an angle that is not less than 20 degrees nor more than 30 degrees.

15. A water jet propulsion apparatus according to claim 9, wherein said first end of said discharge pipe extends toward said discharge portion of said pump casing, said second end of said discharge pipe extends horizontally, and said first and said second end of said discharge pipe are joined by a curved portion.

16. A water jet propulsion apparatus according to claim 9, wherein said main shaft has a first end and a second end, said first end extending downwards into said pump casing and said second end connected through a transmission to a horizontal drive shaft located outside of said pump casing.

* * * * *